US005318153A

United States Patent [19]

Saito et al.

[11] Patent Number: 5,318,153

[45] Date of Patent: Jun. 7, 1994

[54] OIL PUMP

[75] Inventors: Yoshinori Saito; Ikuo Misumi, both of Kanagawa, Japan

[73] Assignee: Atsugi Unisia Corporation, Japan

[21] Appl. No.: 830,893

[22] Filed: Feb. 4, 1992

[30] Foreign Application Priority Data

Feb. 8, 1991 [JP] Japan ..... 3-004791[U]

[51] Int. Cl.[5] ..... F16N 13/20

[52] U.S. Cl. ..... 184/31; 184/6.28; 418/171

[58] Field of Search ..... 184/31, 6.28, 6.27; 418/171, 166, 167, 168, 169, 170

[56] References Cited

U.S. PATENT DOCUMENTS

| | | | |
|---|---|---|---|
| 1,816,508 | 7/1931 | Wilsey | 418/170 |
| 2,358,275 | 7/1944 | Hess | 418/171 |
| 2,416,987 | 3/1947 | Fleischer | 418/171 |
| 3,574,489 | 4/1971 | Pierrat | 418/171 |
| 4,193,746 | 3/1980 | Aman, Jr. | 418/171 |

FOREIGN PATENT DOCUMENTS

| | | | |
|---|---|---|---|
| 0207693 | 7/1959 | Austria | 418/171 |
| 3620705 | 12/1987 | Fed. Rep. of Germany . | |
| 3628163 | 12/1987 | Fed. Rep. of Germany . | |
| 3840863 | 6/1989 | Fed. Rep. of Germany | 418/171 |
| 60-167176 | 11/1985 | Japan | F04C 2/08 |
| 61-70507 | 5/1986 | Japan | F01M 1/02 |
| 61-171885 | 10/1986 | Japan | F04C 2/10 |

*Primary Examiner*—Ira S. Lazarus
*Assistant Examiner*—Alan B. Cariaso
*Attorney, Agent, or Firm*—Ronald P. Kananen

[57] ABSTRACT

An oil pump comprises a housing, a cover, an inner gear having external teeth and a recess, and an outer gear having internal teeth engaged with the external teeth of the inner gear. The housing or the cover includes an engagement protrusion to be engaged with the recess of the inner gear for supporting the inner gear during assembly.

7 Claims, 4 Drawing Sheets

OIL PUMP

BACKGROUND OF THE INVENTION

The present invention relates to an oil pump and, particularly to an internal gear type oil pump which serves as a lubricating pump for a vehicle engine.

One of previously known oil pumps of this type is disclosed, for example, in JP-U 61-171885. This oil pump comprises an external tooth type drive gear or inner gear which is connected to a drive shaft such as a crankshaft for unitary rotation therewith, and a driven gear or outer gear which has internal teeth engaged with external teeth of the inner gear and is received in a space or pump chamber of a pump housing in a manner to be nonconcentric with the inner gear for rotating therewith. Oil is delivered to an engine, and so forth, due to volume variations of a cavity defined between addendums of the two gears when the drive shaft rotates. Additionally, the inner gear has a collar portion for positioning in the pump housing.

With the previously known oil pump, the collar portion of the inner gear permits positioning of the inner gear. However, since the collar portion protrudes from the inner gear in an axial direction thereof, the oil pump has an increased overall length in the axial direction, and machining of the inner gear itself is complicated, resulting in an increase in its manufacturing cost.

It is, therefore, an object of the present invention to provide an oil pump which has a decreased overall length in an axial direction thereof, with simple machining and easy positioning of an inner gear upon mounting.

SUMMARY OF THE INVENTION

There is provided, according to the present invention, an oil pump adapted to be driven by a drive shaft rotatable about an axis, comprising:

a pump housing;

a pump cover;

said pump housing and said pump cover having a chamber, said chamber having axially spaced two end walls with respect to the axis and a peripheral wall interconnecting said axially spaced two end walls to define said chamber;

an outer gear disposed in said chamber; and an inner gear having an end face opposed to one of said two end walls upon being inserted into said chamber;

wherein said one of said two walls has a protruding portion extending toward the other of said two end walls, and said inner gear has a recess extending inwardly from said end face and engageable with said protruding portion for holding said inner gear in a predetermined appropriate position relative to said outer gear.

DETAILED DESCRIPTION OF THE INVENTION

Figure 1:
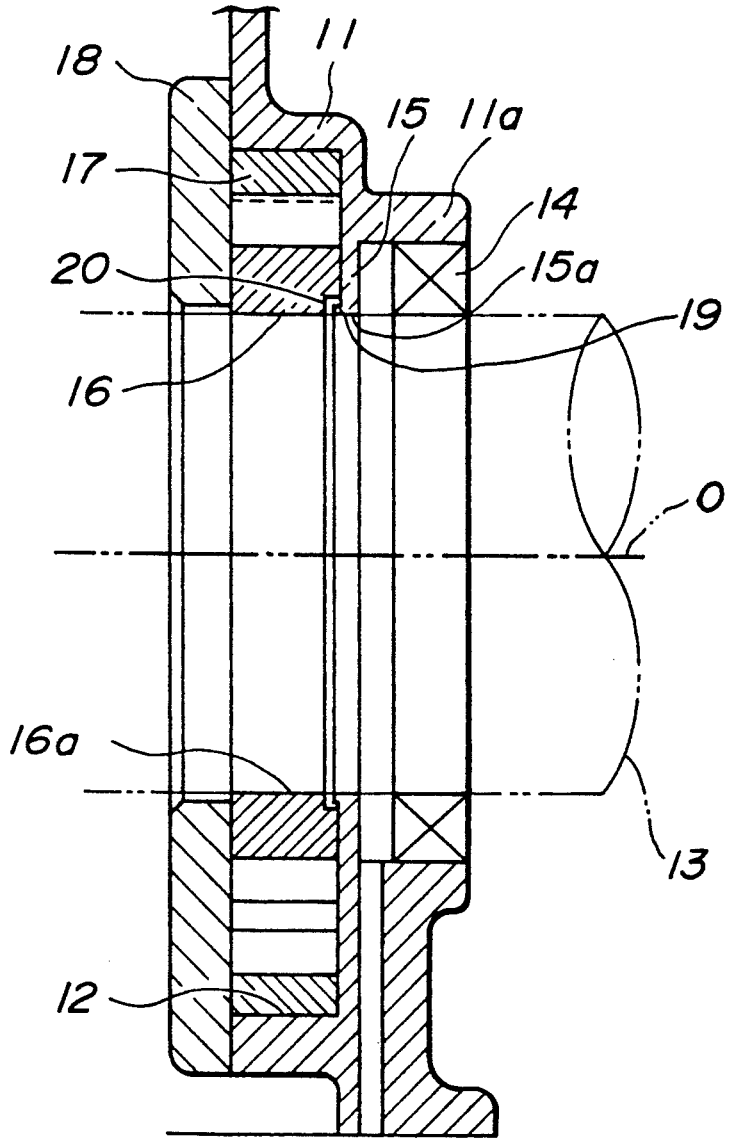
FIG. 1 is a longitudinal section showing a first preferred embodiment of an oil pump according to the present invention.

Referring to the drawings, preferred embodiments of the present invention will be described.

FIG. 1 shows a first preferred embodiment of the present invention, wherein reference numeral 11 designates a pump housing having as a space a circular pump chamber 12 therein, and reference numeral 13 designates a drive shaft rotatable about an axis 0 and arranged to extend through the pump chamber 12 of the pump housing 11 for rotation with a crankshaft of an engine. Fixed to the pump housing 11 on the inner periphery of an annular protrusion **11*a* is an annular oil seal 14 for carrying out sealing between the pump chamber 12 and the drive shaft 13. The pump chamber 12 is defined by a side wall 15 which has a bearing hole 15*a* for the drive shaft 13 substantially in the center thereof. Received in the pump chamber 12 are an inner gear 16 rotatably mounted to the drive shaft 13, and a circular outer gear 17 eccentrically disposed on the side of the outer periphery of the inner gear 16. Additionally, a pump cover 18 for concealing the pump chamber 12 is secured to the pump housing 11 on the inside thereof by bolts, and an engagement protrusion 19 is formed on the side wall 15 at an edge of the bearing hole 15*a* on the side of the pump chamber 12. Specifically, this engagement protrusion 19 is formed circularly along the edge of the bearing hole 15*a***, with a sufficiently small amount of protrusion.

The inner gear 16 of sintered metal is formed block, and has in the center thereof an engagement hole **16*a* in which the drive shaft 13 is fitted, and on the outer periphery thereof a plurality of external teeth which engage with a plurality of internal teeth provided on the inner periphery of the outer gear 17**.

Additionally, at an edge of an engagement hole **16*a* formed on end end face on the side of the side wall 15, the inner gear 16 has an engagement recess 20 to be engaged with the engagement protrusion 19. This engagement recess 20 is shaped circularly, and has an inner diameter slightly greater than the outer diameter of the engagement protrusion 19, and a depth greater than the height of the engagement protrusion 19. When the engagement protrusion 19 is engaged with the engagement recess 20, a predetermined clearance is maintained between a tip of the protrusion 19 and a base of the recess 20** without any contact with each other.

Accordingly, in this embodiment, when assembling component parts of the oil pump, and when receiving the inner and outer gears 16, 17 together in the pump chamber 12 of the pump housing 11, the outer gear 17 is fitted in and supported on the inner periphery of the pump chamber 12, whereas the inner gear 16 is supported in suspension through the engagement recess 20 engaged with the engagement protrusion 19. Thus, the inner gear 16 has a restricted displacement in a radial direction thereof on the inner periphery of the outer gear 17; that is, it is prevented from falling down, facilitating a positioning thereof in an axial direction of the drive shaft 13 and the outer gear 17 and in a direction perpendicular thereto. As a result, the drive shaft 13 can easily be fitted in the engagement hole **16*a* of the inner gear 16**, contributing to an improvement of assembly efficiency.

Further, since the inner gear 16 is not supported by a faucet type collar portion as the prior art, but through the engagement recess 20 engaged with the engagement protrusion 19 having a small amount of protrusion, the overall length of the oil pump can be reduced in an axial direction thereof.

Still further, since the engagement recess 20 can be formed to have a depth sufficiently decreased in response to the engagement protrusion 19 without requirements of high accuracy machining, the entirety of the inner gear 16 can be made of sintered metal, resulting in an easy manufacture and a reduced manufacturing cost.

Furthermore, upon assembling, once the drive shaft 13 is fitted in the engagement hole 16*a* of the inner gear 16, the entirety of the inner gear 16 is slightly lifted so that the engagement recess 20 stands over the engagement protrusion 19, obtaining a noncontact state between the protrusion 19 and the recess 20. As a result, the sliding friction resistance between the two protrusion 19 and the recess 20 can be prevented from being produced during pump rotation, resulting in approximately an 8 to 10% reduction of a pump output loss.

Figure 2:
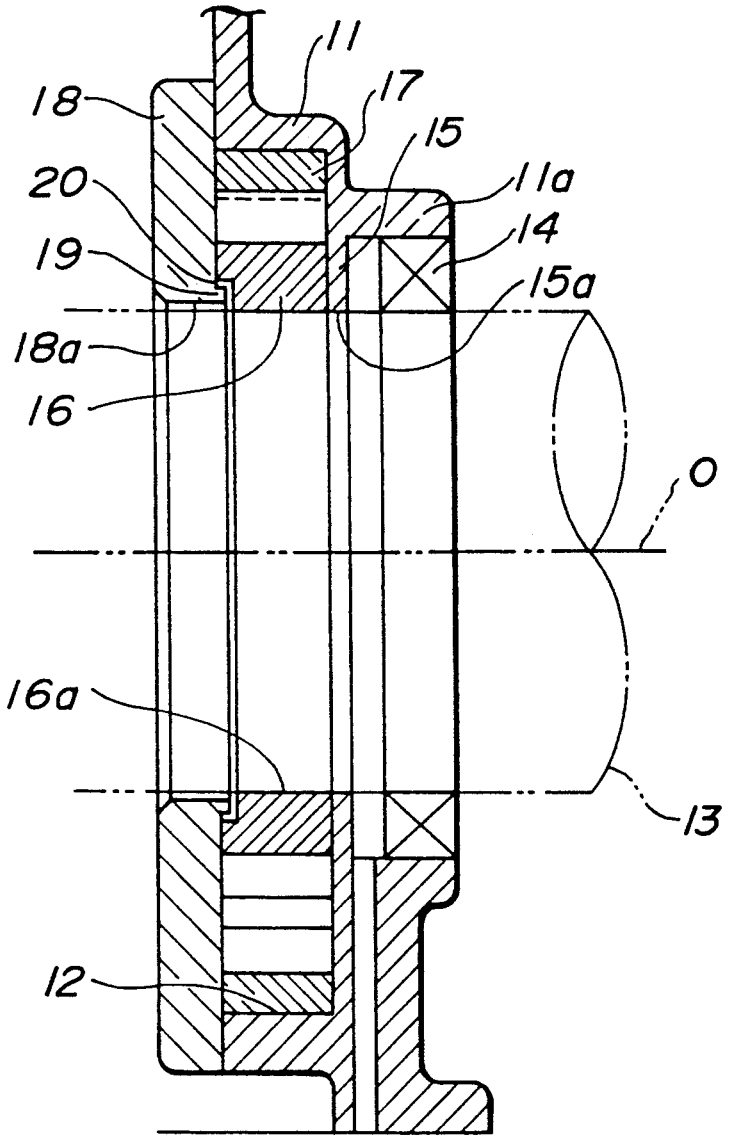
FIG. 2 is a view similar to FIG. 1, showing a second preferred embodiment of the present invention.

FIG. 2 shows a second preferred embodiment of the present invention. The circular engagement protrusion 19 is integrated with the pump cover 18 at an edge of an insertion hole 18*a* for the drive shaft 13, whereas the circular engagement recess 20 to be engaged with the engagement protrusion 19 is integrated with the inner gear 16 on the side of the other end face thereof. The concrete architecture of the engagement protrusion and recess 19, 20 is the same as that of the first preferred embodiment.

Accordingly, this embodiment provides not only the same effect as that of the first preferred embodiment, but another effect that the disposition of the engagement protrusion 19 on the side of the pump cover 18 facilitates machining thereof relatively.

Figure 3:
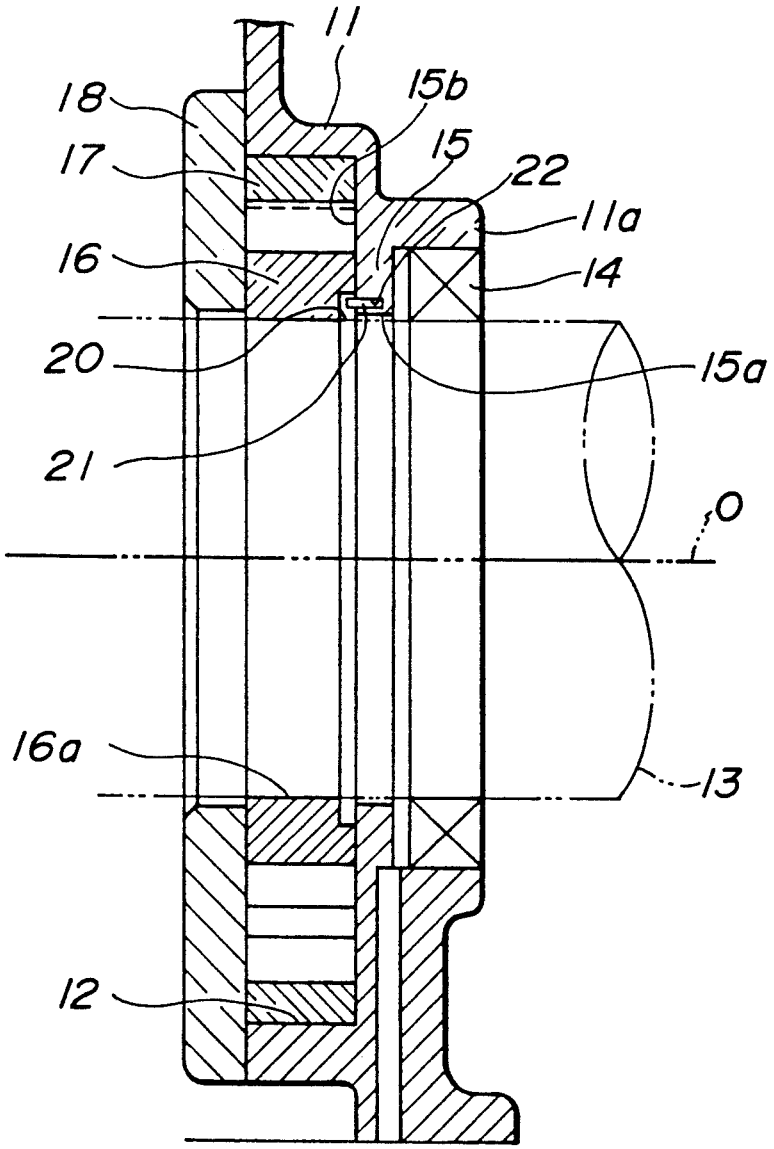
FIG. 3 is a view similar to FIG. 2, showing a second preferred embodiment of the present invention.
Figure 4:
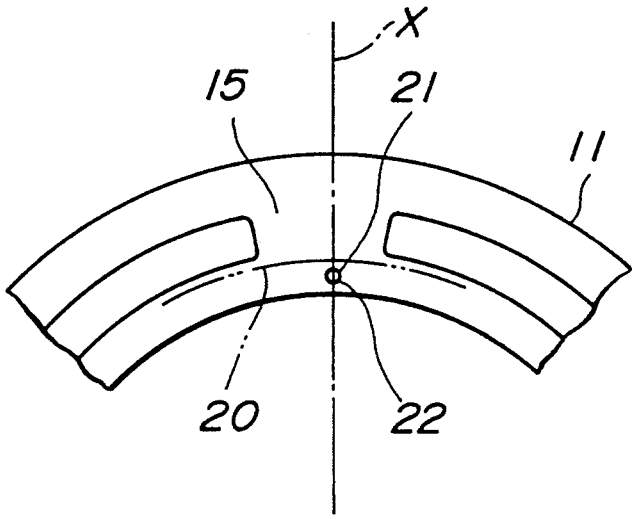
FIG. 4 is a fragmentary side view of the oil pump in FIG. 3.

FIGS. 3 and 4 show a third preferred embodiment of the present invention. A single engagement pin 21 as a protrusion is disposed to the pump housing 11, whereas the same engagement recess 20 as that of the first preferred embodiment is integrated with the inner gear 16. Specifically, the side wall 15 of the pump housing 11 has a small fixing hole 22 axially formed in the vicinity of an upper end of the edge of the bearing hole 15*a* on the side of the pump chamber 12, and the engagement pin 21 press fitted in the fixing hole 21 on the side of the pump chamber 12. This engagement pin 21 is disposed to the pump housing 11 through the fixing hole 21 to be on a perpendicular line X (see FIG. 4) which intersects an axis of the drive shaft 13 at right angles, and has a sufficiently small amount of protrusion from the fixing hole 22 in a manner similar to the engagement protrusion 19.

On the other hand, the engagement recess 20 is circular, and formed to have an axis situated slightly downward of the axis of the drive shaft 13 in a state where an inner periphery upper end of the engagement recess 20 is engaged with the engagement pin 21, and a depth slightly greater that the amount of protrusion of the engagement pin 21.

Accordingly, in this embodiment, upon assembling of component parts, once the engagement recess 20 of the inner gear 16 is preliminarily engaged with the engagement pin 21 to be in suspension, the inner gear 16 can be positioned in the axial direction of the drive shaft 13 and the outer gear 17, and in a direction perpendicular thereto, resulting in the same effect as that of each of the above embodiments.

Further, in this embodiment, since the single engagement pin 21 is merely disposed to the pump housing 11 through the fixing hole 22 differently from the engagement protrusion of each of the above embodiments, not only a weight of the pump housing 11 can be reduced, but the amount of protrusion of the engagement pin 21 can be adjusted by an amount of press fit thereof in the fixing hole 22, allowing an optional change of an axial position of the inner gear 16 relative to the engagement recess 20.

Furthermore, since the engagement protrusion is not provided, and thus the entirety of an inner end face 15*b* of the side wall 15 can be machined flatwise on the side of the pump chamber 12 to be machined with high accuracy in connection with the gears 16, 17, a machining thereof is facilitated, contributing to an improvement of a manufacturing efficiency and a reduction in its manufacturing cost.

Figure 5:
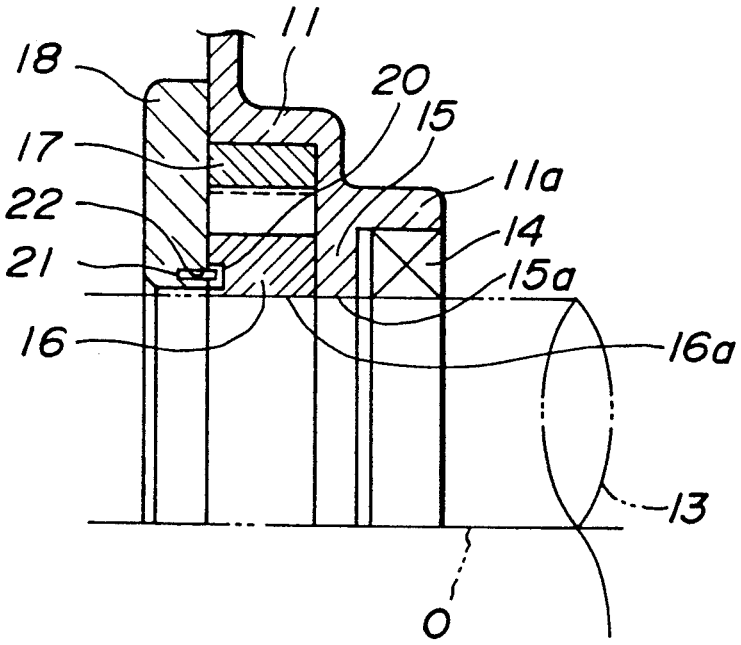
FIG. 5 is a fragmentary longitudinal section showing a fourth preferred embodiment of the present invention.

FIG. 5 shows a fourth preferred embodiment of the present invention. In this embodiment, the same fixing hole 22 as that of the third preferred embodiment is formed in the pump cover 18, in which the engagement pin 21 is press fitted. Additionally, the engagement recess 20 is formed on the other end face of the inner gear 16. Accordingly, this embodiment provides the same effect as that of the third preferred embodiment.

It is to be noted that the present invention is not limited to the architecture of the above embodiments. By way of example, the engagement protrusion 19 may not be formed circularly, but intermittently in a circumferential direction thereof. Additionally, this protrusion 19 may be formed at one spot on the upper end of the pump housing as the engagement pin 21. These variations result in a reduced weight of the pump housing 11 and an improved machining efficiency of the inner end face 15*b* of the side wall 15.

What is claimed is:

1. An oil pump adapted to be driven by a drive shaft rotatable about an axis, comprising:

a pump housing;

a pump cover;

said pump housing and said pump cover having a chamber, said chamber having two axially spaced end walls with respect to the axis and a peripheral wall interconnecting said two axially spaced end walls to define said chamber;

an outer gear disposed in said chamber; and an inner gear having an end face opposed to one of said two end walls upon being inserted into said chamber;

wherein said one of said two walls has a protruding portion extending toward the other of said two end walls, and said inner gear has a recess extending inwardly from said end face and engageable with said protruding portion obtaining a non-contact state between said recess and said protruding portion for holding said inner gear in a predetermined appropriate position relative to said outer gear.

2. An oil pump as claimed in claim 1, wherein said pump housing has said one of said two end walls having said protruding portion.

3. An oil pump as claimed in claim 1, wherein said pump cover has said one of said two end walls having said protruding portion.

4. An oil pump as claimed in claim 1, wherein said protruding portion is in the form of a pin.

5. An oil pump adapted to be driven by a drive shaft rotatable about an axis, comprising:

a pump housing;

a pump cover, said pump housing and said pump cover having a chamber, said chamber having two axially spaced end walls with respect to the axis and a peripheral wall interconnecting said two axially spaced end walls to define said chamber;

an outer gear disposed in said chamber;

an inner gear having an end face opposed to one of said two end walls upon being inserted into said chamber; and means for assembling said inner and outer gears in said pump chamber so that the outer gear is fitted in and supported on an inner periphery of the pump chamber, while the inner gear is supported in suspension in said pump chamber, said assembling means including an engagement protrusion formed on one of said pump housing and said pump cover and an engagement recess on said inner gear, said engagement protrusion and said engagement recess engaging each other in a non-contact state for assembling said inner and outer gears in said pump chamber.

6. The oil pump as set forth in claim 5, wherein said engagement protrusion has a small amount of protrusion so that the overall length of the oil pump can be reduced in an axial direction thereof.

7. The oil pump as set forth in claim 5, wherein said inner gear has an engagement hole and a restricted displacement in a radial direction thereof on the inner periphery of the outer gear, thus facilitating a position thereof in an axial direction of a drive shaft and the outer gear and in a direction perpendicular thereto, so that a drive shaft can easily be fitted in the engagement hole in the inner gear.

* * * * *